US009145726B2

(12) United States Patent
Li et al.

(10) Patent No.: US 9,145,726 B2
(45) Date of Patent: Sep. 29, 2015

(54) CONCEALED DOOR CLOSER

(71) Applicant: Oubao Security Technology Co., Ltd., Lishui, Zhejiang Province (CN)

(72) Inventors: Haojie Li, Lishui (CN); Zhenfeng Fu, Lishui (CN); Guowei Jiang, Lishui (CN); Zhenbo Wu, Lishui (CN); Hongbo Liu, Lishui (CN); Weibin Lan, Lishui (CN); Chenxi Zhu, Lishui (CN); Jun Zhang, Lishui (CN); Maochen Zhang, Lishui (CN)

(73) Assignee: Oubao Security Technology Co., Ltd., Lishui, Zhejiang Province (CN)

( * ) Notice: Subject to any disclaimer, the term of this patent is extended or adjusted under 35 U.S.C. 154(b) by 0 days.

(21) Appl. No.: 14/208,188

(22) Filed: Mar. 13, 2014

(65) Prior Publication Data

US 2014/0304942 A1 Oct. 16, 2014

(30) Foreign Application Priority Data

Apr. 10, 2013 (CN) ..... 2013 1 0121545

(51) Int. Cl.
*E05F 15/614* (2015.01)
*E05F 15/63* (2015.01)
*E05F 15/603* (2015.01)

(52) U.S. Cl.
CPC ..... *E05F 15/614* (2015.01); *E05F 15/603* (2015.01); *E05F 15/63* (2015.01); *Y10T 16/293* (2015.01); *Y10T 16/299* (2015.01); *Y10T 16/56* (2015.01); *Y10T 16/577* (2015.01); *Y10T 16/585* (2015.01)

(58) Field of Classification Search
CPC ..... E05F 15/603; E05F 15/611; E05F 15/614; E05F 15/616; E05F 15/619; E05F 15/63; E05Y 2600/41; E05Y 2600/412; E05Y 2600/46; E05Y 2600/45; Y10T 16/56; Y10T 16/568; Y10T 16/577; Y10T 16/585; Y10T 16/593; Y10T 16/287; Y10T 16/293; Y10T 16/299
See application file for complete search history.

(56) References Cited

U.S. PATENT DOCUMENTS 1,898,609 A * 2/1933 Anderson ..... 16/61
1,942,185 A * 1/1934 Richter et al. ..... 16/69
1,976,090 A * 10/1934 Platzer ..... 475/14

(Continued)

FOREIGN PATENT DOCUMENTS

CN 201214939 Y 4/2009
CN 201916375 U 8/2011

(Continued)

*Primary Examiner* — Jeffrey O Brien
(74) *Attorney, Agent, or Firm* — Muncy, Geissler, Olds & Lowe, P.C.

(57) ABSTRACT

A concealed door closer includes a housing, an input shaft and an output shaft, the input shaft being connected to a motor, wherein a joining member is arranged between the input shaft and the output shaft, and two ends of the joining member are respectively provided with an upper connection piece and a lower connection piece, which are connected to a roller via vertical rotation shaft, and wherein both the input shaft and the output shaft are provided with a left connection piece and a right connection piece, which are horizontally connected to the roller via a horizontal rotation shaft. The components in the door closer have a simple structure and may be easily processed and assembled. The size of the joint after assembly is equivalent to that of the joining member, so the overall size is small.

12 Claims, 12 Drawing Sheets

(56) References Cited

U.S. PATENT DOCUMENTS

| | | | | |
|---|---|---|---|---|
| 3,087,720 | A * | 4/1963 | Catlett | 49/30 |
| 7,219,391 | B1 * | 5/2007 | Luca | 16/50 |
| 7,316,096 | B2 * | 1/2008 | Houser et al. | 49/345 |
| 7,484,333 | B2 * | 2/2009 | Houser et al. | 49/506 |
| 7,774,984 | B2 * | 8/2010 | Hsu | 49/341 |
| 7,946,079 | B2 * | 5/2011 | Brown | 49/139 |
| 8,109,038 | B2 * | 2/2012 | Houser et al. | 49/345 |
| 8,407,937 | B2 * | 4/2013 | Houser | 49/139 |
| 8,499,495 | B2 * | 8/2013 | Houser et al. | 49/340 |
| 2004/0098915 | A1 * | 5/2004 | Baldry | 49/339 |
| 2006/0010771 | A1 * | 1/2006 | Houser et al. | 49/341 |
| 2006/0244271 | A1 * | 11/2006 | Hass | 292/336.3 |
| 2008/0052997 | A1 * | 3/2008 | Houser et al. | 49/340 |
| 2009/0025297 | A1 * | 1/2009 | Hsu | 49/341 |
| 2009/0139146 | A1 * | 6/2009 | Houser et al. | 49/340 |
| 2011/0094160 | A1 * | 4/2011 | Houser | 49/31 |
| 2011/0257797 | A1 * | 10/2011 | Burris et al. | 700/282 |
| 2011/0302848 | A1 * | 12/2011 | Nixon | 49/506 |
| 2011/0314741 | A1 * | 12/2011 | Nixon | 49/349 |
| 2012/0023824 | A1 * | 2/2012 | Mason | 49/29 |
| 2012/0029701 | A1 * | 2/2012 | Houser | 700/275 |
| 2012/0085035 | A1 * | 4/2012 | Nixon | 49/334 |
| 2012/0159852 | A1 * | 6/2012 | Houser et al. | 49/340 |

FOREIGN PATENT DOCUMENTS

| | | | |
|---|---|---|---|
| CN | 201933938 | U | 8/2011 |
| CN | 202718511 | U | 2/2013 |
| JP | 2001-090431 | A | 4/2001 |

* cited by examiner

CONCEALED DOOR CLOSER

CROSS-REFERENCE TO RELATED APPLICATIONS

This application claims priority to Chinese Patent Application No. 201310121545.3, filed on Apr. 10, 2013. The entire disclosure of Chinese Patent Application No. 201310121545.3 is incorporated herein by reference.

BACKGROUND

1. Technical Field

The present application relates to door closer, and in particular a concealed door closer.

2. Background Art

At present, door closers and especially some concealed door closers are more and more widely used. These concealed door closers may be hidden in doors or door frames and drive the doors to rotate via a concealed slide rail and a rock arm, thereby maintaining intrinsic aesthetic qualities of the doors. The existing door closers are usually mounted externally and employ gear mesh transmission to realize a 90-degree transmission connection between the input shaft and the output shaft. However, such a structure has many disadvantages. Firstly, such a structure has a large size. In order to conveniently mount a concealed door closer in a door or door frame and to maintain aesthetic qualities of the door, it is preferable to use a door closer of a small size, so the size of the door closer is very important. Secondly, such a structure achieves a low transmission efficiency. An externally mounted door closer needs a large rotation force, and a low transmission efficiency of the bevel, gear leads to a large drive load for the motor in the door closer, thereby greatly reducing the life span of the motor. Thirdly, such a structure requires high precision in the mounting position. Due to the manner of gear mesh connection, the output shaft and the input shaft must form an angle of 90 degrees; otherwise the gear mesh connection will be affected.

When a door closer and especially an electric door closer is used, the motor of the door closer drives the input shaft to rotate, and the input shaft then drives the output shaft to rotate. Sometimes, the door may not be opened or closed in a normal automatic mode, or some malicious or accidental man-made damage may occur, causing the output shaft to be suddenly jammed. In this case, the transmission mechanism and the drive motor of the door closer may be severely damaged. After multiple damages, the operation of the door closer may be easily affected, and the door closer may be even broken.

Moreover, an instrument for measuring the rotation angle of the output shaft is often mounted on the door closer. In the prior art, a contact portion is arranged between the output shaft and the instrument for measuring the rotation angle of the output shaft. After the measurement is done many times, the contact portion may have a positional shift, and measurement errors may be increased, thereby shifting the door closer at the door closing position and even making it impossible to close the door.

SUMMARY

In order to eliminate at least one of the above-mentioned disadvantages of the prior art, the disclosure provides a concealed door closer, which has a least one of the advantages including a smart structural design, a small size, a high transmission efficiency, including a safety protection mechanism and a long life span.

In order to solve at least one of the existing technical problems, the disclosure may adopt the following technical solutions.

In one example, a concealed door closer may include a housing, an input shaft and an output shaft, the input shaft being connected to a motor, wherein a joining member is arranged between the input shaft and the output shaft, and two ends of the joining member are respectively provided with an upper connection piece and a lower connection piece, which are connected to a roller via a vertical rotation shaft, and wherein both the input shaft and the output shaft are provided with a left connection piece and a right connection piece, which are horizontally connected to the roller via a horizontal rotation shaft.

The components in the door closer have a simple structure and may be easily processed and assembled. The size of the joint after assembly is equivalent to that of the joining member, so the overall size is small. During transmission, the rotation of the input shaft directly drives the output shaft via the joining member, so the transmission efficiency may be improved. Further, the bending angle of the transmission connection may be flexibly adjusted, and there is a low precision requirement on the mounting position for the door closer.

In at least one example, the roller may have cross-like through holes, and the vertical rotation shaft goes through the upper connection piece, the through hole and the lower connection piece in this order; the vertical rotation shaft has a through hole, and the horizontal rotation shaft has a fixation hole extending along the axis thereof for letting a rivet to go through; the rivet goes through the fixation hole and the through hole of the vertical rotation shaft to fix the vertical rotation shaft to the horizontal rotation shaft. In at least one example, an inner end of the horizontal rotation shaft may be provided with a key groove, and the vertical rotation shaft has a snap groove, the horizontal rotation shaft being engaged in the snap groove.

This structural design is smart, and the phenomenon of separation from the roller due to an excessively high frequency or speed will not occur.

In at least one example, the input shaft may be connected to a safety clutch device, which may include a transition shaft connected to the input shaft, and connection ends of the input shaft and the transition shaft are respectively fixed to an input rotary disk and a transition rotary disk; the input rotary disk has a group of spaced-apart through holes, within which steel balls are arranged, and the transition rotary disk has grooves whose positions correspond to those of the through holes of the input rotary disk; the input shaft goes through a steel ball pressing plate, which presses the steel balls into the grooves, and an outer end of which is provided with an elastic member for pressing the steel ball pressing plate; a pressing cover for limiting the elastic member is fixed to an outer end of the housing, and the input shaft goes through the pressing cover; the transition shaft is rotatably connected to the housing via an end face hearing and is connected to the motor.

As a result, when the door closer is in normal use, the steel ball pressing plate presses the steel balls into the grooves to connect the input rotary disk to the output rotary disk, so as to realize a transmission connection between the input shaft and the output shaft. In an accidental case, when it is difficult for the input shaft to rotate the output shaft, the rotation force of the input shaft is too large, so the grooves in the input rotary disk give a thrust force in the axial direction to the steel balls to move the steel balls outwardly and separate the steel balls from the grooves, so that the input rotary disk and the output rotary disk are separated from each other. In this way, each component of the door closer can be well-protected. After the input rotary disk rotates by a certain angle, due to the elastic force of the elastic member, each steel ball returns to the next groove and is again in the transmission state. Thus, the components may be prevented from being damaged due to an excessively large force.

In at least one example, the pressing cover may be thread connected to the housing, and an inner end face of the pressing cover is provided with an elastic tablet the pressing cover has a screw hole, within which a screw for pressing the elastic tablet is arranged.

As a result, the position of the pressing cover may be locked, and the stroke of the elastic member may be fixed. The pressing cover may appropriately move inwardly or outwardly to adjust the tension of the elastic member. The tension of the elastic member is important for the safe clutch between the input shaft and the output shaft. If the elastic member presses the steel ball pressing plate too hard, the safety factor may be reduced. If the elastic member presses the steel ball pressing plate too lightly, the transmission between the input shaft and the output shaft will be loosened and instable.

In at least one example, the groove may be a tapered groove whose size matches that of the steel ball, and the elastic member is a disk spring or a coil spring. Such an arrangement is beneficial for the safe clutch between the input shaft and the output shaft. Preferably, the elastic member is a disk spring, and the output shaft goes through a group of elastic disks. Door closers of different types require the elastic member having different length. If a disk spring is selected, its length can be adjusted in a desirable manner. In contrast, a coil spring is widely used and has a low manufacture cost.

In at least one example, a drive gear may be mounted on the output shaft, and a driven gear in mesh transmission with the drive gear is mounted on the housing; a magnet base is mounted on a central axis of the driven gear, and a magnet is arranged on the magnet base; a fixation base for fixing an angle sensor is arranged on the housing. Through gear mesh transmission, the angle sensor may reduce angle errors and prevent angle errors from being generated during slip or misalignment. The position of the angle sensor matches that of the magnet. By measuring the rotation angle of the magnet in the magnetic field direction, the angle sensor measures the rotation angle of the output shaft in a contactless manner and may reduce angle errors. The output shaft is mounted on the housing via a first bearing, both the upper and lower ends of which are provided with a snap spring engaged with the output shaft. Such an arrangement is simple, convenient and firm. The door closer has a good quality and a low cost, and may achieve processing simplicity and reliable precision, so the door closer may be widely promoted.

At least one of the above and other solutions can achieve at least one of the following beneficial effects.

In the disclosure, a gimbal structure is employed in the transmission connection between the input shaft and the output shaft, thereby achieving a high transmission efficiency and a small size, and the phenomenon of separation from the roller due to an excessively high frequency or speed will not occur. Besides, a safety clutch device may be arranged. Thus, in a case where a door is not opened or closed in a normal automatic mode, in order to prevent any malicious or accidental man-made damage, once the steel balls receive a force, the steel balls push the steel ball pressing plate and the disk spring, so that each steel ball is separated from the corresponding groove in the input rotary disk and rotates to the next groove to cause an angular displacement of the clutch, thereby protecting the motor and the output shaft. The speed reduction gear in the motor and each component of the output shaft may be protected, and it is possible to avoid the phenomenon of an increased gap between the connected components due to slight damages. The application of a safety clutch to the door closer can largely reduce the maintenance frequency and cost, and the force is adjusted by adjusting the tension of the elastic member via the pressing cover according to the door weight. The door closer has a good quality and a low cost, and may achieve processing simplicity and reliable precision, so the door closer may be widely promoted.

Figure 1:
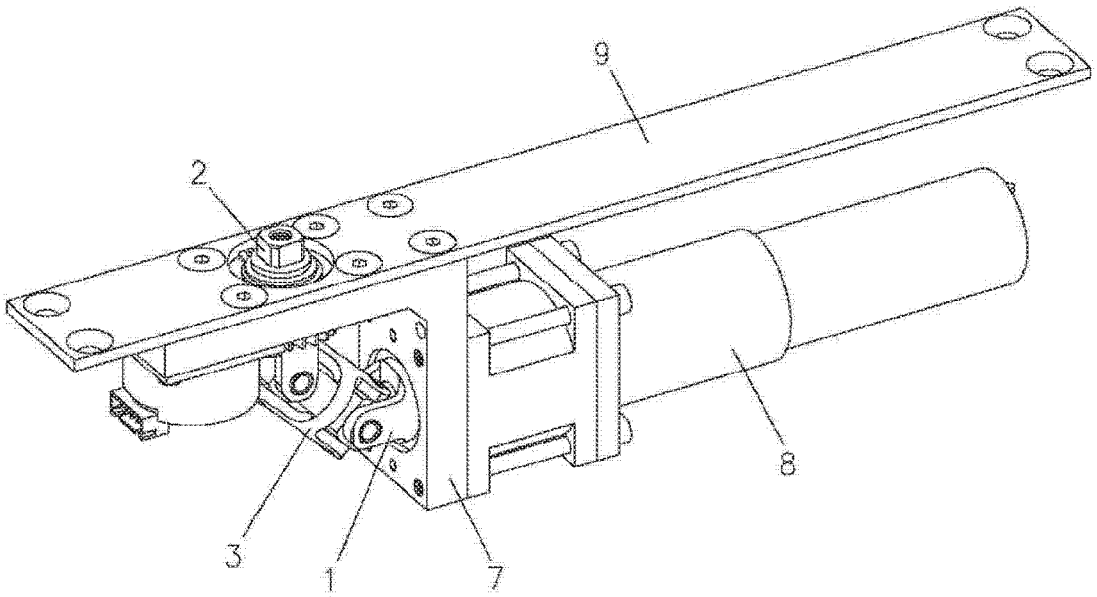
FIG. 1 is a structural diagram of at least one example of the disclosure.
Figure 2:
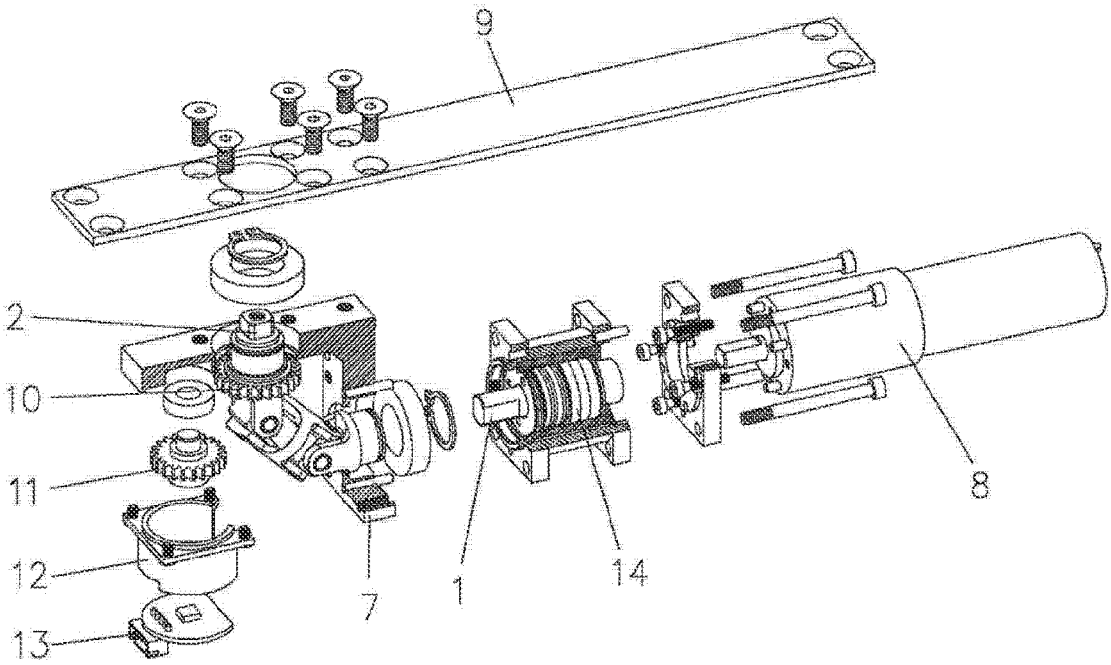
FIG. 2 is an exploded diagram of at least one example of the disclosure.
Figure 3:
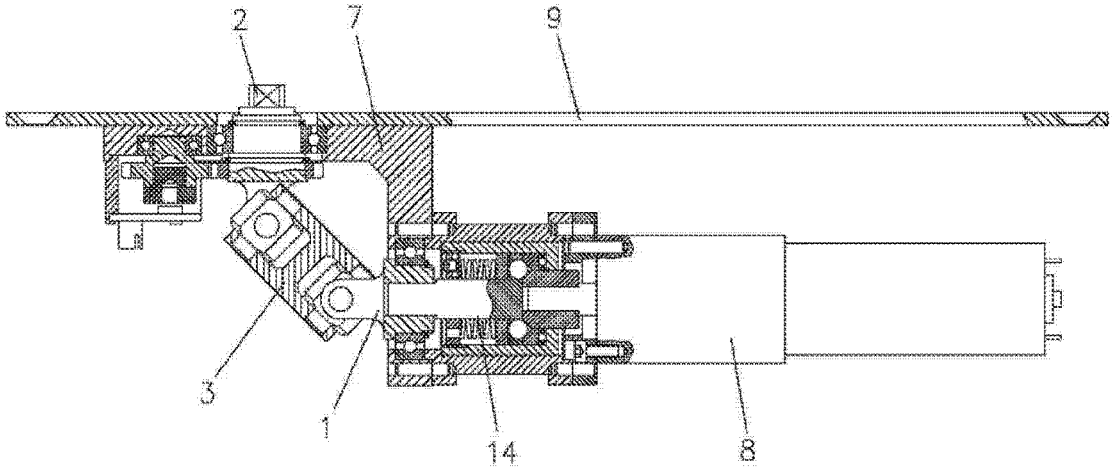
FIG. 3 is a cross-sectional diagram of at least one example of the disclosure.
Figure 4:
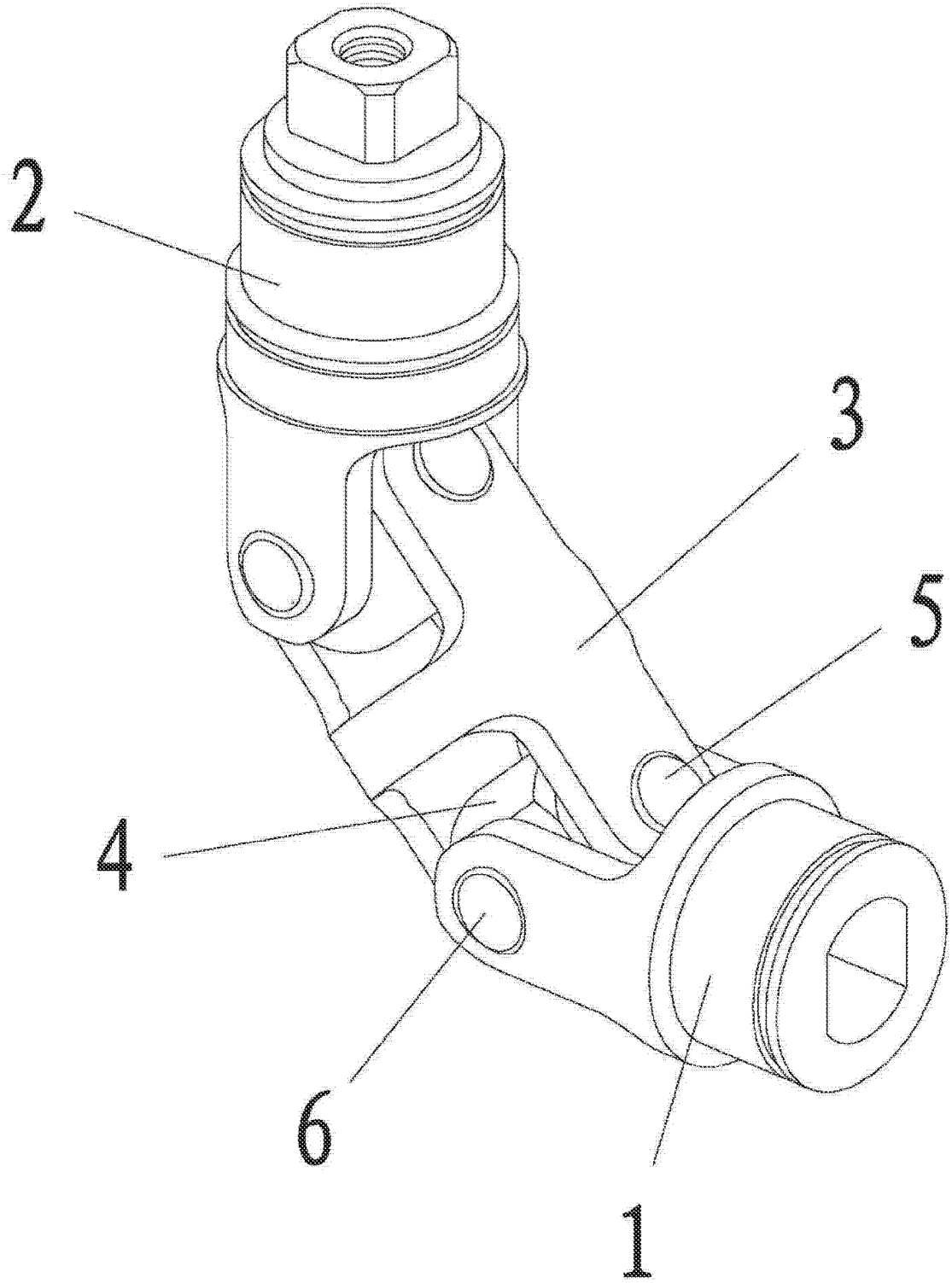
FIG. 4 is a diagram of the connection structure between an input shaft and an output shaft in at least one example of the disclosure.
Figure 5:
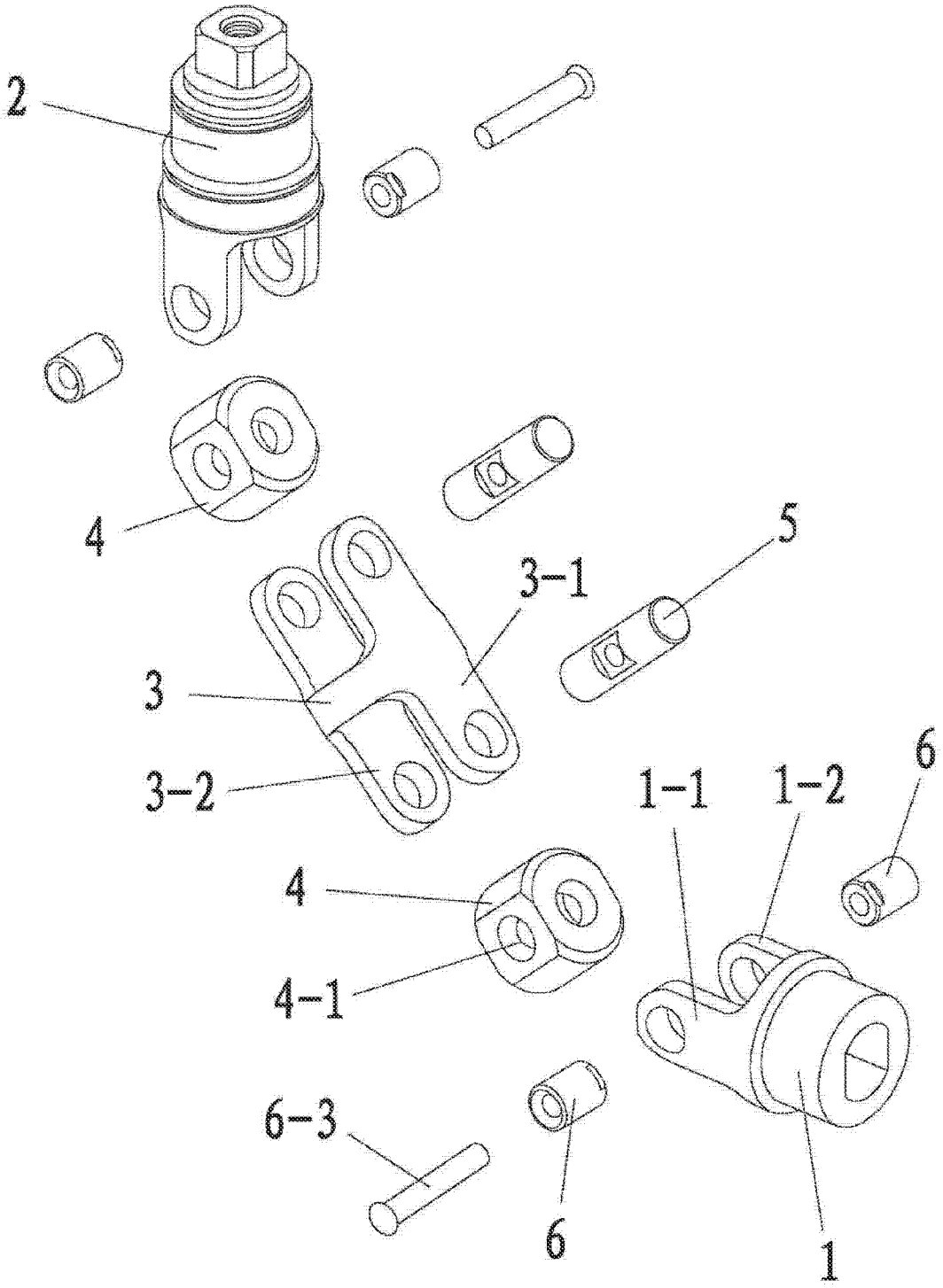
FIG. 5 is an exploded diagram of the connection structure between the input shaft and the output shaft in at least one example of the disclosure.
Figure 6:
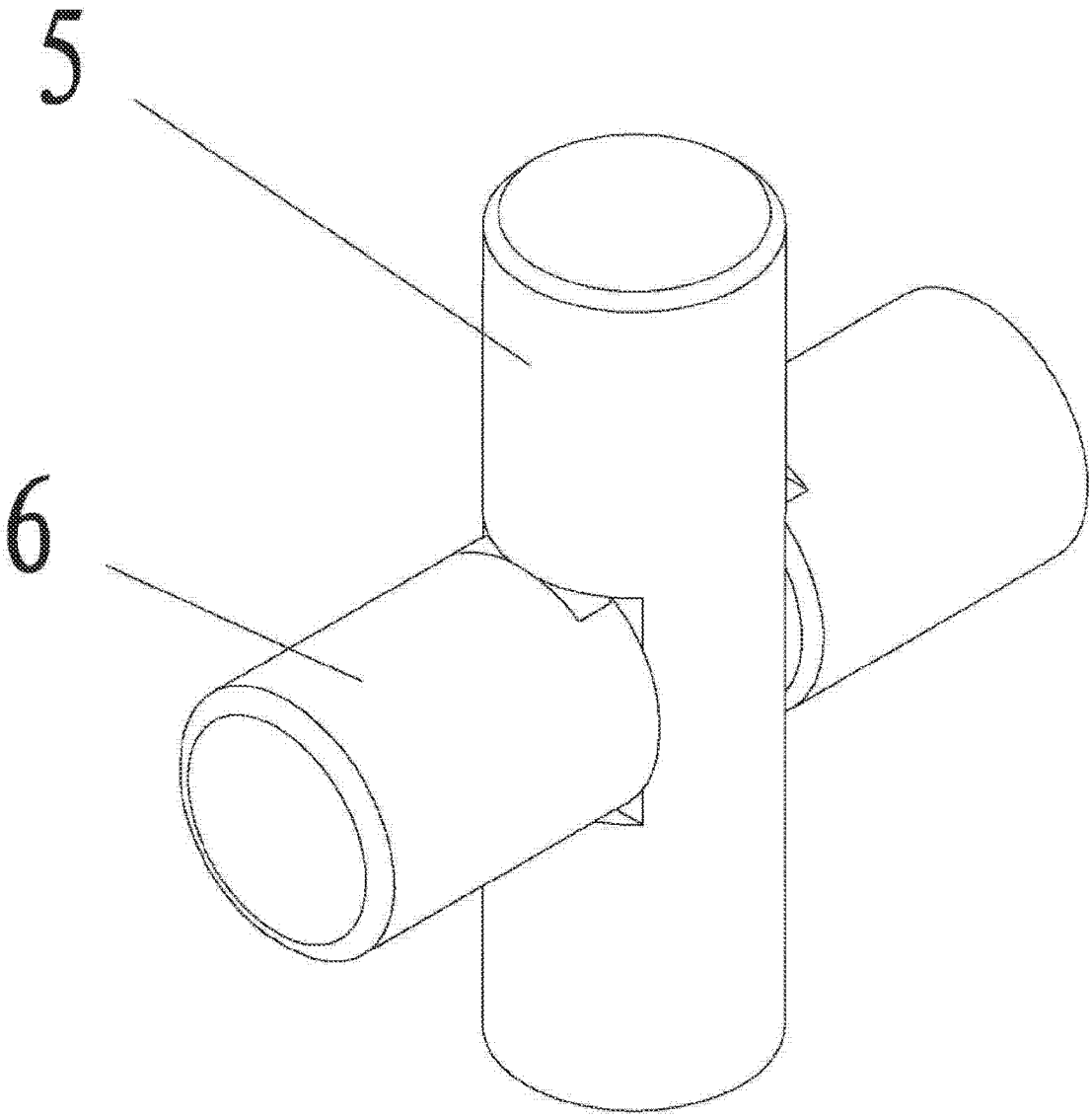
FIG. 6 is a structural diagram of rotation shafts in at least one example of the disclosure.
Figure 7:
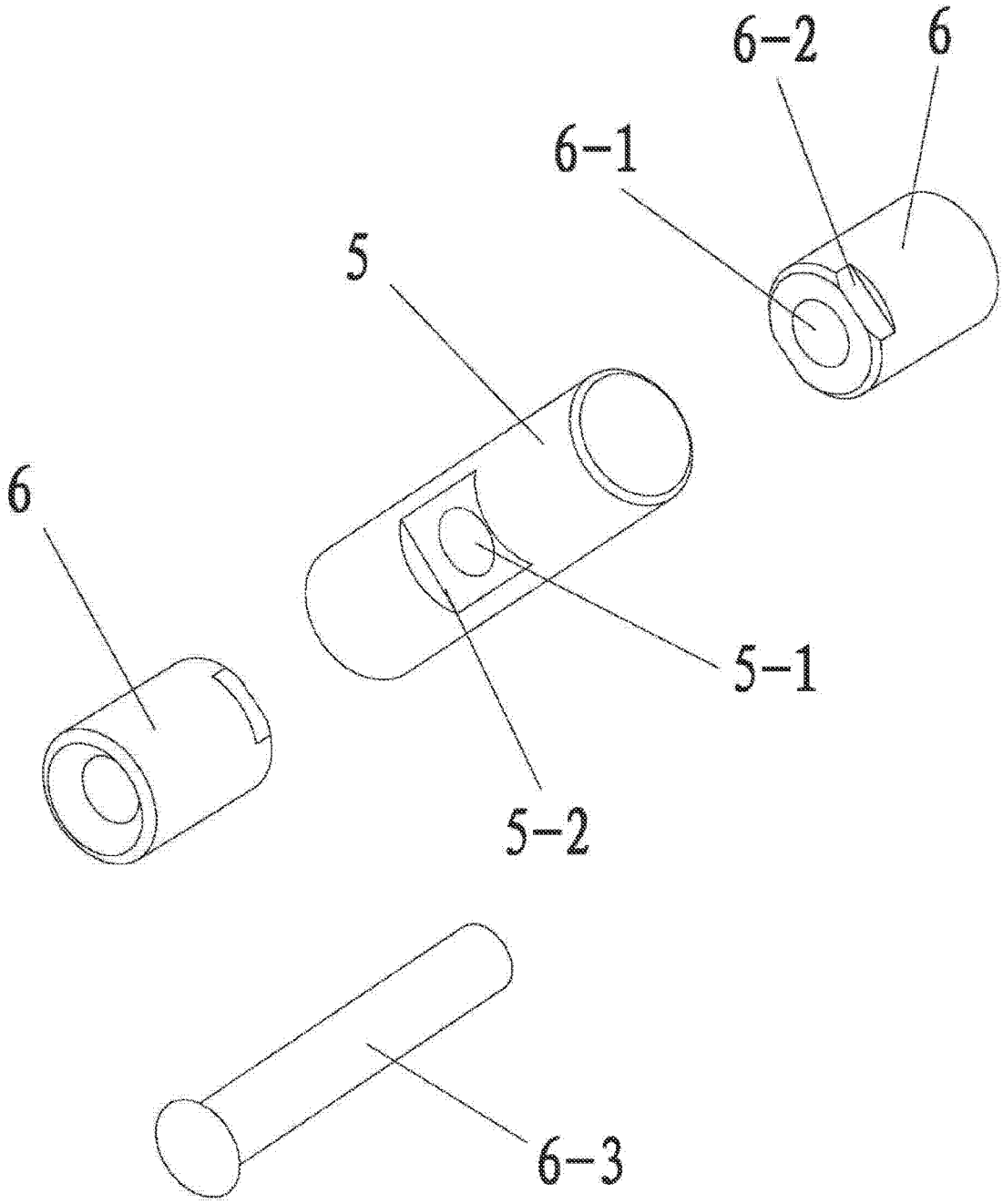
FIG. 7 is an exploded diagram of the rotation shafts in at least one example of the disclosure.
Figure 8:
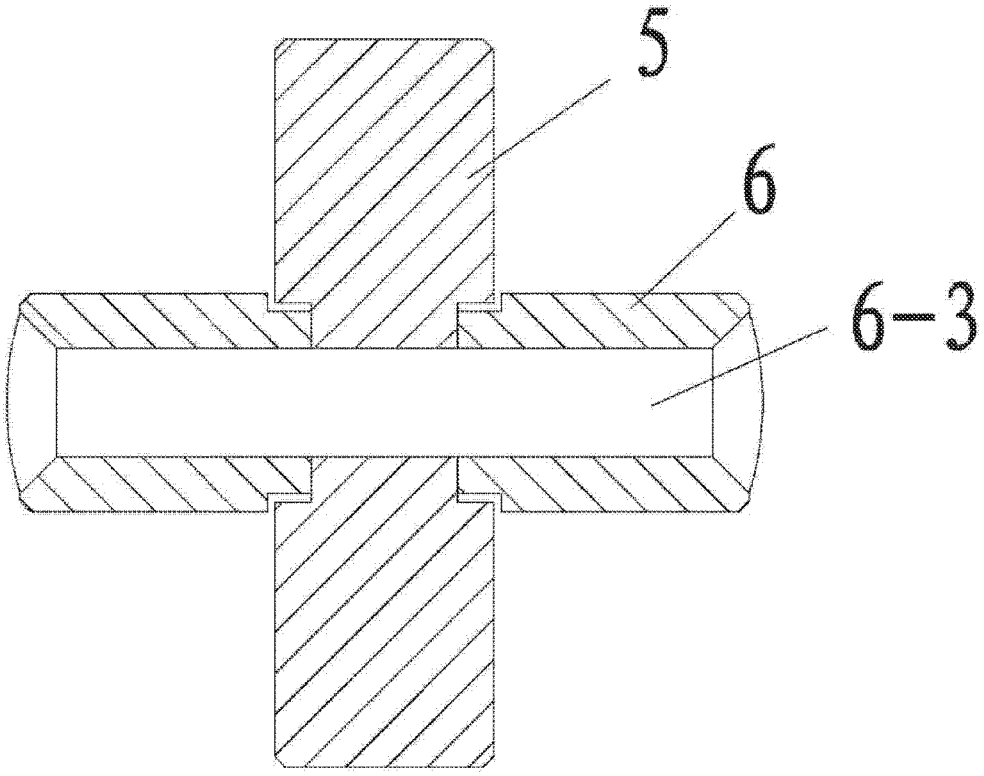
FIG. 8 is a cross-sectional diagram of the rotation shafts in at least one example of the disclosure.
Figure 9:
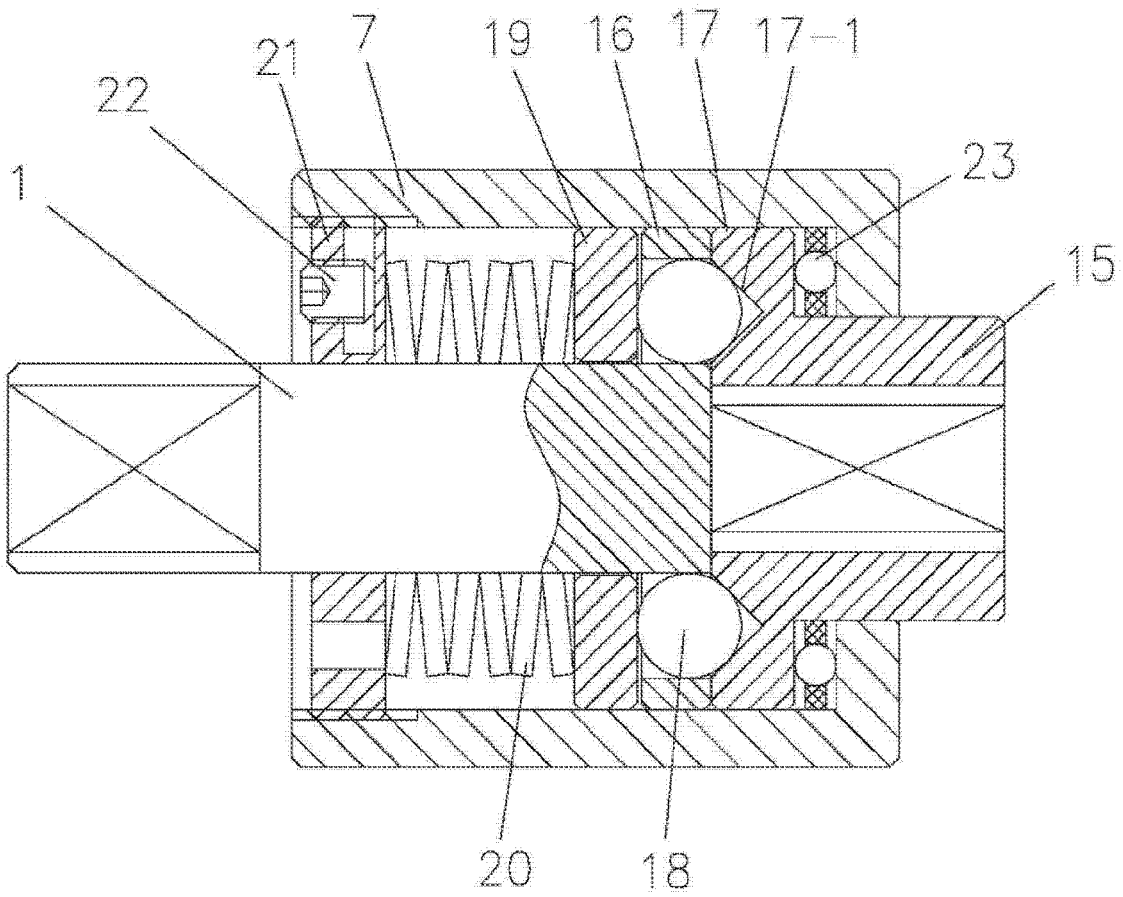
FIG. 9 is a cross-sectional diagram of a safety clutch device in at least one example of the disclosure.
Figure 10:
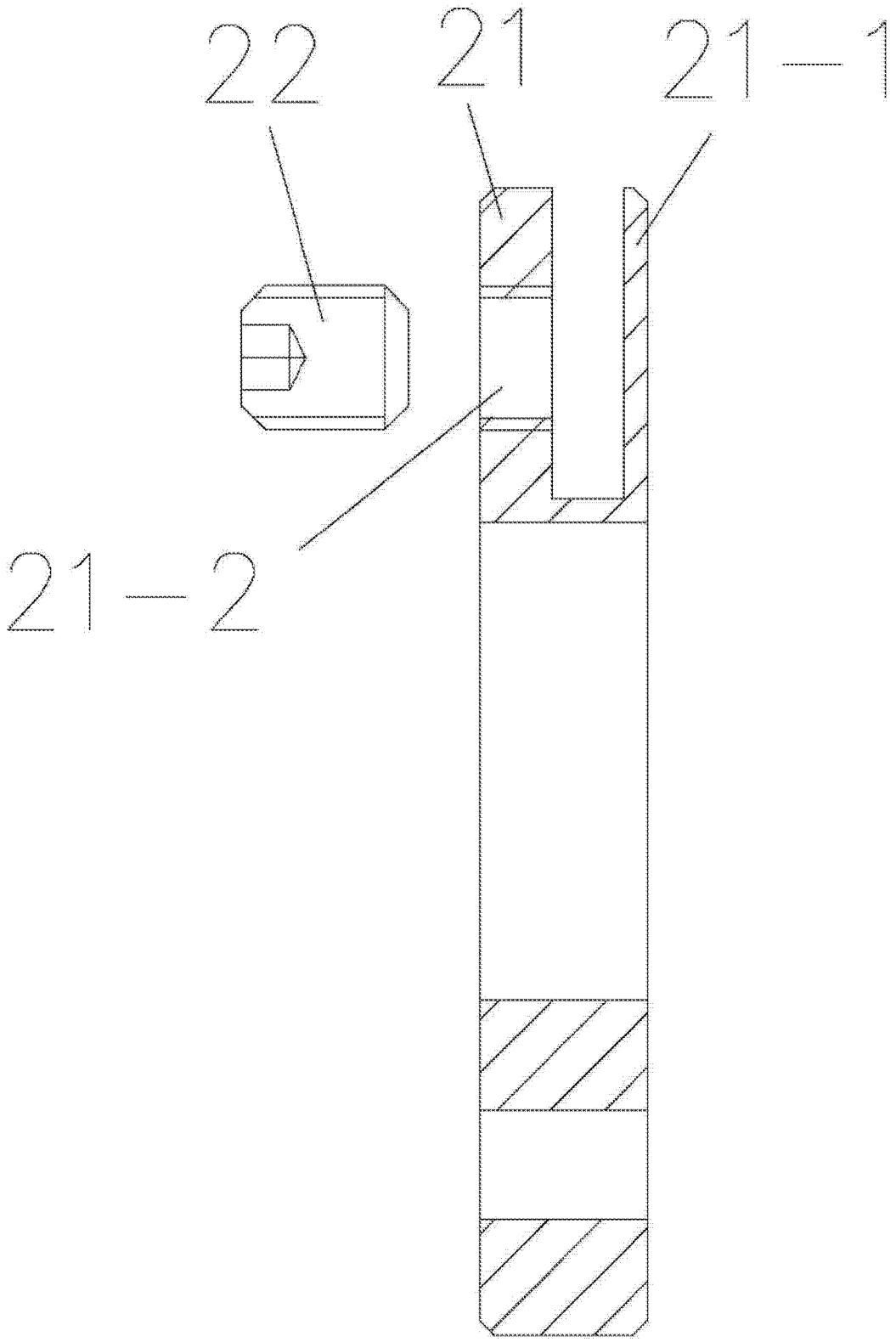
FIG. 10 is a cross-sectional diagram of a pressing cover in at least one example of the disclosure.
Figure 11:
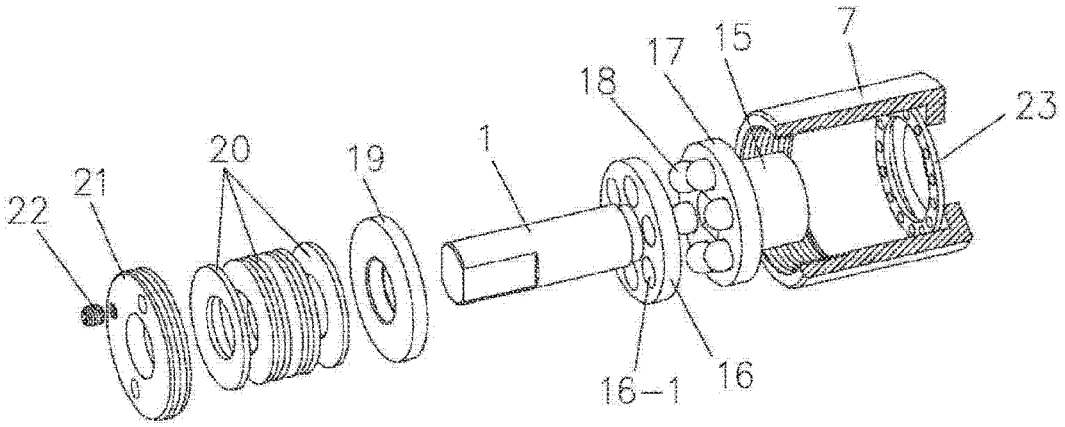
FIG. 11 is an exploded diagram of the safety clutch device in at least one example of the disclosure.
Figure 12:
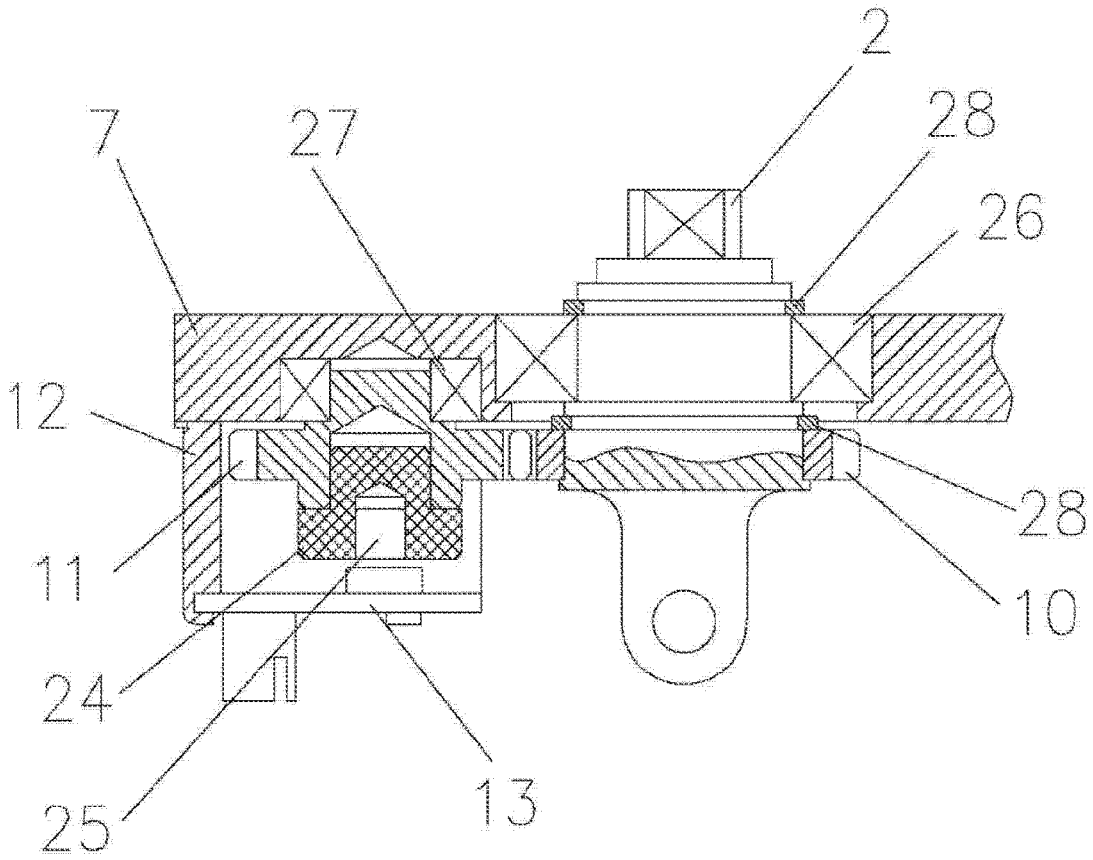
FIG. 12 is a cross-sectional diagram showing the measurement of the rotation angle of the output shaft in at least one example of the disclosure.
Figure 13:
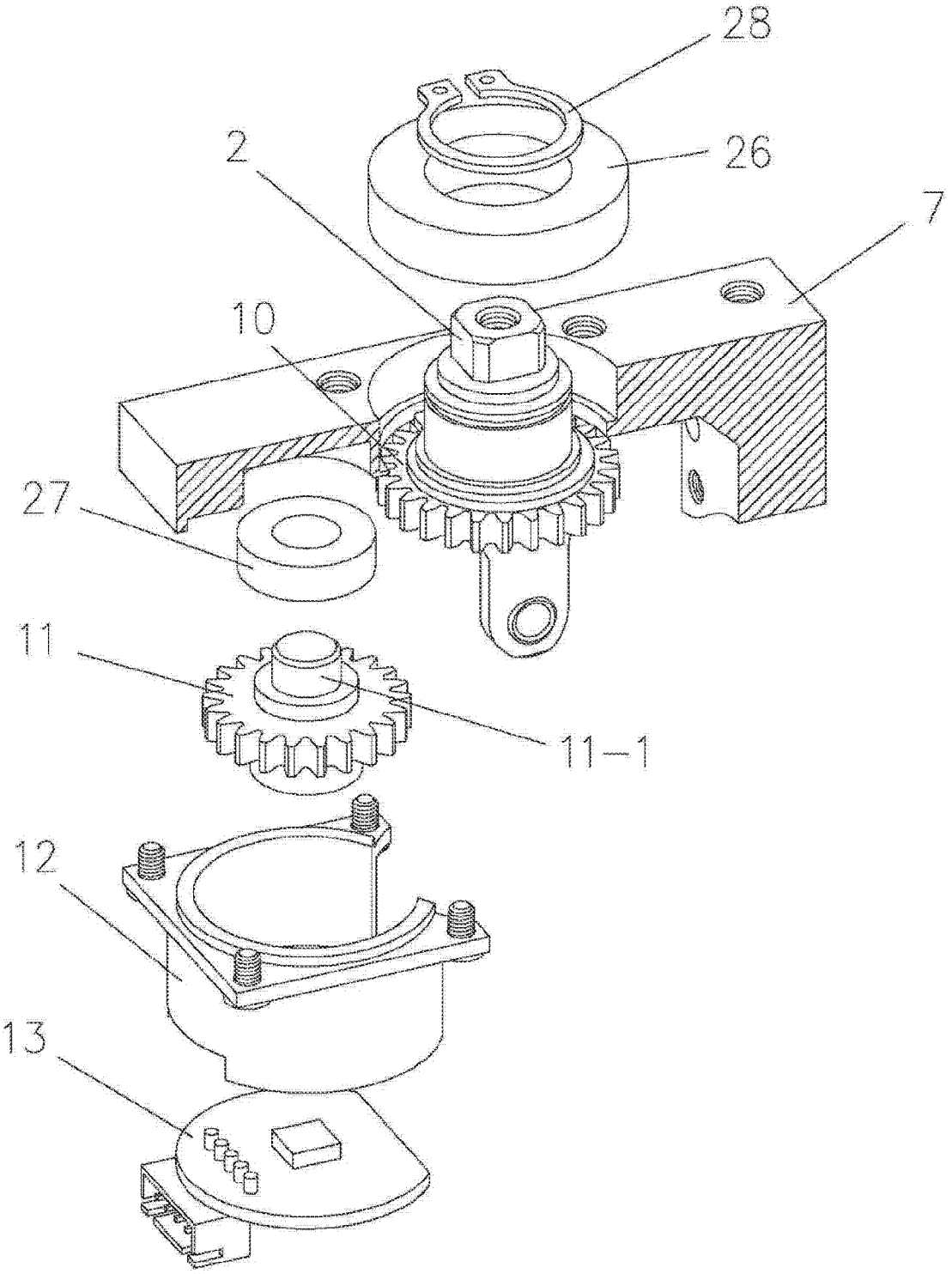
FIG. 13 is an exploded diagram showing the measurement of the rotation angle of the output shaft in at least one example of the disclosure.
Figure 14:
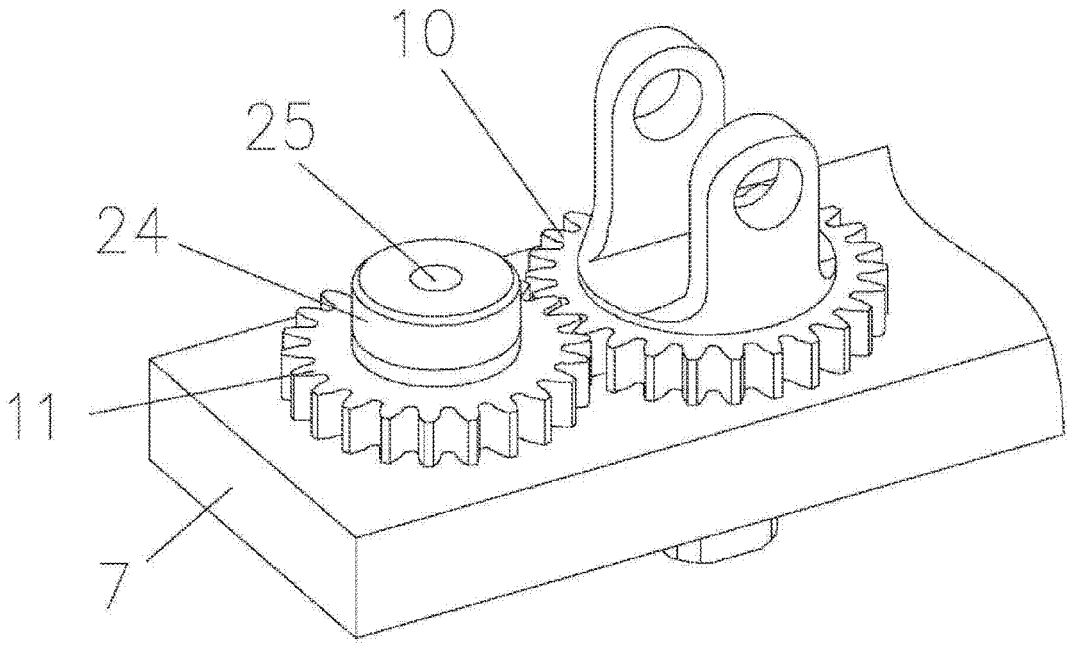
FIG. 14 is a structural diagram of the bottom for the measurement of the rotation angle of the output shaft in at least one example of the disclosure.

REFERENCE NUMERALS input shaft 1, left connection piece 1-1, right connection piece 1-2, output shaft 2, joining member 3, upper connection piece 3-1, lower connection piece 3-2, roller 4, vertical rotation shaft 5, through hole 5-1, horizontal rotation shaft 6, fixation hole 6-1, key groove 6-2, rivet 6-3, housing 7, motor 8, mounting plate 9, drive gear 10, driven gear 11, central axis 11-1, fixation base 12, angle sensor 13, safety clutch device 14, transition shaft 15, input rotary disk 16, through hole 16-1, transition rotary disk 17, groove 17-1, steel ball 18, steel ball pressing plate 19, elastic member 20, pressing cover 21, elastic tablet 21-1, screw hole 21-2, screw 22, end face bearing 23, magnet base 24, magnet 25, first bearing 26, second bearing 27, snap spring 28.

DESCRIPTION OF THE EMBODIMENTS

Hereinafter, the disclosure is described in detail with reference to the drawings:

As shown in the drawings, in at least one example, a concealed door closer may include a housing 7, an input shaft 1 and an output shaft 2, the input shaft 1 being connected to a motor 8, wherein a joining member 3 is arranged between the input shaft 1 and the output shaft 2, and two ends of the joining member 3 are respectively provided with an upper connection piece 3-1 and a lower connection piece 3-2, which are connected to rollers 4 via vertical rotation shafts 5, and wherein the input shaft 1 is provided with a left connection piece 1-1 and a right connection piece 1-2, and the output shaft 2 is also provided with a left connection piece and a right connection piece, the left connection piece and the right connection piece being horizontally connected to the rollers 4 via horizontal rotation shafts 6.

In at least one example, the roller 4 has cross-like through holes 4-1, and the vertical rotation shaft 5 goes through the upper connection piece 3-1, the through hole 4-1 and the lower connection pieces 3-2 in this order. The vertical rotation shaft 5 has a through hole 5-1, and the horizontal rotation shaft 6 has a fixation hole 6-1 extending along the axis thereof for letting a rivet 6-3 to go through. The rivet 6-3 goes through the fixation hole 6-1 and the through hole 5-1 to fix the vertical rotation shaft 5 to the horizontal rotation shaft 6. An inner end of the horizontal rotation shaft 6 is provided with a key groove 6-2, and the vertical rotation shaft 5 has a snap groove 5-2, the horizontal rotation shaft 6 being engaged in the snap groove 5-2. This structural design is smart, and the phenomenon of separation from the rollers due to an excessively high frequency or speed will not occur.

The input shaft 1 may be connected to a safety clutch device 14, which includes a transition shaft 15 connected to the input shaft 1, and connection ends of the input shaft 1 and the transition shaft 15 are respectively fixed to an input rotary disk 16 and a transition rotary disk 17. The input rotary disk 16 has a group of spaced-apart through holes 16-1, within which steel balls 18 are arranged, and the transition rotary disk 17 has grooves 17-1 whose positions correspond to those of the through holes 16-1. The input shaft 1 goes through a steel ball pressing plate 19, which presses the steel balls 18 into the grooves 17-1, and an outer end of the steel ball pressing plate 19 is provided with one or more elastic members 20 for pressing the steel ball pressing plate 19. A pressing cover 21 for limiting the elastic member 20 is fixed to an outer end of the housing 7, and the input shaft 1 goes through the pressing cover 21. The transition shaft 15 is rotatably connected to the housing 7 via an end face bearing 23 and is connected to the motor 8. The pressing cover 21 is thread-connected to the housing 7, and an inner end face of the pressing cover 21 is provided with an elastic tablet 21-1. The pressing cover 21 has a screw hole 21-2, within which a screw 22 for pressing the elastic tablet 21-1 is arranged. The groove 17-1 is a tapered groove whose size matches that of the steel ball 18, and the elastic member 20 may be a disk spring or a coil spring.

A drive gear 10 is mounted on the output shaft 2, and a driven gear 11 in mesh transmission with the drive gear 10 is mounted on the housing 7. A magnet base 24 is mounted on a central axis 11-1 of the driven gear 11, and a magnet 25 is arranged on the magnet base 24. A fixation base 12 for fixing an angle sensor 13 is arranged on the housing 7. The output shaft 2 is mounted on the housing 7 via a first bearing 26, the upper and lower ends of which are respectively provided with a snap spring 28 engaged with the output shaft 2. The central axis 11-1 of the driven gear 11 is mounted on the housing 7 via a second bearing 27.

In the disclosure, the door closer may be mounted in a door or door frame in a hidden manner, and the input shaft 1 and the output shaft 2 of the door closer are cross-connected to each angle at a certain angle, so the input shaft 1 and the output shaft 2 are connected to each other via a joining member having a gimbal structure. Such a structure has a small size and can achieve a high transmission efficiency. Moreover, the bending angle can be arbitrarily controlled, and there is a low precision requirement on the mounting position for the door closer. Thus, such a structure is very suitable for the concealed door closer. A safety clutch device 14 may be mounted between the input shaft 1 and the motor a to protect the internal connection structure of the door closer. The output shaft 2 of the door closer is connected to an angle measuring instrument via a gear mesh structure, so that the rotation angle of the output shaft 2 can be accurately measured and the measured angle will not be shifted due to a slip.

When the door closer is in use, the motor 8 drives the transition shaft 15 to rotate, and the transition rotary disk 17 on the transition shaft 15 is connected to the input rotary disk 16 on the input shaft 1 via a group of steel balls 18. The steel balls 18 are engaged in the through holes 16-1, and the steel ball pressing plate 19 presses the steel balls 18 into the grooves 17-1, so as to realize a transmission connection between the transition shaft 15 and the input shaft 1. The input shaft 1 is in transmission connection with the output shaft 2 via the joining member 3, and the output shaft 2 is connected to a rotary arm, which drives the door to rotate. The drive gear 10 is fixed to the output shaft 2, and the driven gear 11 in mesh with the drive gear 10 is mounted in the housing 7. The rotation angle measuring instrument 13 is mounted on the axis of the driven gear 11.

Although the disclosure has been illustrated and described with reference to the preferred embodiments, a person having ordinary skills in the art can understand that any modifications in the form and details may be made within the scope of the claims.

The invention claimed is:

1. A concealed door closer comprising a housing, an input shaft and an output shaft, the input shaft being connected to a motor, wherein a joining member is arranged between the input shaft and the output shaft, a first end of two ends of the joining member is provided with a first upper connection piece and a first lower connection piece, a second end of two ends of the joining member is provided with a second upper connection piece and a second lower connection piece, the first upper connection piece and the first lower connection piece are connected to a first roller via a first vertical rotation shaft, and the second upper connection piece and the second lower connection piece are connected to a second roller via a second vertical rotation shaft;

the input shaft is provided with a first left connection piece and a first right connection piece, and the first left connection piece and the first right connection piece are horizontally connected to the first roller via a first horizontal rotation shaft; and the output shaft is provided with a second left connection piece and a second right connection piece, and the second left connection piece and the second right connection piece are horizontally connected to the second roller via a second horizontal rotation shaft.

2. The concealed door closer according to claim 1 wherein the first roller has a cross-shaped through hole and the first vertical rotation shaft goes through the first upper connection piece, the through hole of the first roller, and the first lower connection piece in that order, respectively;

the first vertical rotation shaft has a through hole, and the first horizontal rotation shaft has a fixation hole extending along the axis thereof for letting a first rivet to go through; wherein the first rivet going through the fixation hole of the first horizontal rotation shaft and the through hole of the first vertical rotation shaft to fix the first vertical rotation shaft to the first horizontal rotation shaft;

the second roller has a cross-shaped through hole and the second vertical rotation shaft goes through the second upper connection piece, the through hole of the second roller, and the second lower connection piece in that order, respectively; and the second vertical rotation shaft has a through hole, and the second horizontal rotation shaft has a fixation hole extending along the axis thereof for letting a second rivet to go through, wherein the second rivet goes through the fixation hole of the second horizontal rotation shaft and the through hole of the second vertical rotation shaft to fix the second vertical rotation shaft to the second horizontal rotation shaft.

3. The concealed door closer according to claim 2 wherein an inner end of the first horizontal rotation shaft is provided with a key groove, and the first vertical rotation shaft has a snap groove, the first horizontal rotation shaft being engaged in the snap groove of the first vertical rotation shaft; and an inner end of the second horizontal rotation shaft is provided with a key groove, and the second vertical rotation shaft has a snap groove, the second horizontal rotation shaft being engaged in the snap groove of the second vertical rotation shaft.

4. The concealed door closer according to claim 1 wherein the input shaft is connected to a safety clutch device, which includes a transition shaft connected to the input shaft, and connection ends of the input shaft and the transition shaft are respectively fixed to an input rotary disk and a transition rotary disk; wherein the input rotary disk has a group of spaced-apart through holes, within which steel balls are arranged, and the transition rotary disk has grooves whose positions correspond to those of the through holes of the input rotary disk;

the input shaft goes through a steel ball pressing plate, which presses the steel balls into the grooves, and an outer end of which is provided with an elastic member for pressing the steel ball pressing plate;

a pressing cover for limiting the elastic member is fixed to an outer end of the housing, and the input shaft goes through the pressing cover; and the transition shaft is rotatably connected to the housing via an end face bearing and is connected to the motor.

5. The concealed door closer according to claim 4 wherein the pressing cover is thread-connected to the housing, and an inner end face of the pressing cover is provided with an elastic tablet; and the pressing cover has a screw hole, within which a screw for pressing the elastic tablet is arranged.

6. The concealed door closer according to claim 4 wherein each groove of the transition rotary disk is a tapered groove whose size matches that of the steel ball, and the elastic member is a disk spring or a coil spring.

7. The concealed door closer according to claim 1 wherein a drive gear is mounted on the output shaft, and a driven gear in mesh transmission with the drive gear is mounted on the housing;

a magnet base is mounted on a central axis of the driven gear, and a magnet is arranged on the magnet base; and a fixation base for fixing an angle sensor is arranged on the housing.

8. The concealed door closer according to claim 7 wherein the output shaft is mounted on the housing via a first bearing, both the upper and lower ends of which are provided with a snap spring engaged with the output shaft, and the central axis of the driven gear is mounted on the housing via a second bearing.

9. The concealed door closer according to claim 1 wherein the first vertical rotational shaft is perpendicular to the first horizontal rotational shaft and the second vertical rotational shaft is perpendicular to the second horizontal rotational shaft.

10. The concealed door closer according to claim 9 wherein the first vertical rotational shaft is directly connected to the first horizontal rotational shaft and the second vertical rotational shaft is directly connected to the second horizontal rotational shaft.

11. The concealed door closer according to claim 9 wherein a first longitudinal axis of the first horizontal rotational shaft and a second longitudinal axis of the second horizontal rotational shaft are parallel to the surface of a mounting plate.

12. The concealed door closer according to claim 1 wherein a first longitudinal axis of the first horizontal rotational shaft and a second longitudinal axis of the second horizontal rotational shaft are perpendicular to both the output shaft and the input shaft.

* * * * *